US005578806A

United States Patent [19]

Hofbauer et al.

[11] Patent Number: 5,578,806

[45] Date of Patent: Nov. 26, 1996

[54] COMPRESSED GAS-BLAST CIRCUIT BREAKER

[75] Inventors: Werner Hofbauer, Baden; Joachim Stechbarth, Siglistorf, both of Switzerland

[73] Assignee: ABB Management AG, Baden, Switzerland

[21] Appl. No.: 506,117

[22] Filed: Jul. 24, 1995

[30] Foreign Application Priority Data

Aug. 1, 1994 [DE] Germany ..... 44 27 163.8

[51] Int. Cl.[6] ..... H01H 33/42; H01H 33/915

[52] U.S. Cl. ..... 218/59; 218/62; 218/63; 218/84

[58] Field of Search ..... 218/43, 45, 57–67, 218/84, 85; 361/604, 612, 618

[56] References Cited

U.S. PATENT DOCUMENTS

| | | | |
|---|---|---|---|
| 3,814,883 | 6/1974 | Milianowicz | 218/85 |
| 4,211,902 | 7/1980 | Tsuchida | 218/43 |
| 4,289,942 | 9/1981 | Milianowicz | 218/62 |
| 4,675,484 | 6/1987 | Ischi et al. | 218/17 |
| 4,678,878 | 7/1987 | Beier | 218/57 |
| 4,935,590 | 6/1990 | Malkin et al. | 218/57 |
| 4,973,806 | 11/1990 | Kirchesch et al. | 218/84 |
| 5,478,980 | 12/1995 | Freeman et al. | 218/59 |

FOREIGN PATENT DOCUMENTS

| | | | |
|---|---|---|---|
| 35 13 264 | 9/1986 | Germany | H01H 33/42 |
| 35 40 474 | 5/1987 | Germany | H01H 33/915 |

OTHER PUBLICATIONS

K. Suzuki et al., "Development of 550kV 1–Break GCB (Part 1) Investigation of Interrupting Chamber Performance", *IEEE*, pp. 1–8 (1992).

*Primary Examiner*—J. R. Scott
*Attorney, Agent, or Firm*—Burns, Doane, Swecker & Mathis

[57] ABSTRACT

The compressed gas-blast circuit breaker includes two moving contact members (1, 2) which are guided to move counter to one another along an axis (3) in a chamber which is filled with insulating gas. These contact members each have an arcing contact (8, 9) and a main current contact (6, 7). An insulating nozzle (10) mounted on a contact member (1) is moved directly by a drive, and compressed gas is passed, during disconnection, through the constriction (11) in the insulating nozzle (10) into an exhaust space (14) from a pressure space (12), which is independent of the switching travel, and/or from a compression space (19), which is operated by the contact members. Drive force is passed to a contact member (2), which absorbs force, from the directly-driven contact member (1), through an insulating part and a speed converter. During disconnection, if the functionally essential parts of the force-absorbing contact member (2), such as the arcing contact (9), the main current contact (7) and the shields, are suitably driven, it forms an insulating path, which can be highly stressed dielectrically, in a short time while optimally using a comparatively small drive force.

15 Claims, 4 Drawing Sheets

COMPRESSED GAS-BLAST CIRCUIT BREAKER

FIELD OF THE INVENTION

The invention is based on a compressed gas-blast circuit breaker having two contact members which are movable relative to one another along an axis in a chamber filled with an insulating gas. Such a compressed gas-blast circuit breaker is preferably used as a power circuit breaker in high voltage electrical power supply networks.

BACKGROUND

In this case, the invention refers background, for example, from a report by H. Toda et al. "Development of 550 kV 1-break GCB (part II)—Development of Prototype" IEEE 92 SM 578-5 PWRD. In this document, a compressed gas-blast circuit breaker is described having two moving contact members, which are arranged in a chamber which is filled with insulating gas, and having a piston/cylinder compression device which produces quenching gas during disconnection. In this circuit breaker, drive energy is transmitted from a first of the two contact members via a lever mechanism, which acts as a speed converter, and an insulating rod to a second of the two contact members. During disconnection, the contact members are moved in opposite directions. This results in a high contact separation speed. In comparison with a compressed gas-blast circuit breaker which is dimensioned in a corresponding manner and has the same contact separation speed, but in the case of which only one of the two contact members is moved, drive energy can thus be saved. However, the lever mechanism and the insulating rod require a considerably enlarged diameter for the chamber transversely with respect to the movement direction of the contact members.

A compressed gas-blast circuit breaker is described in U.S. Pat. No. 4,973,806, having a switching chamber in which, during a switching operation, drive energy is transmitted by a force transmission device from a moving arcing member via an insulating nozzle to a moving erosion contact of a stationary contact member. This compressed gas-blast circuit breaker is distinguished by a high separation speed of the arcing contacts with a low drive energy and a quenching geometry which is retained unchanged and is governed by the moving contact member and the insulating nozzle, as a result of which a large insulating path is formed within a very short time between the erosion contacts during disconnection.

SUMMARY OF THE INVENTION

Accordingly, one object of the invention is to reduce the required drive energy and the diameter of the chamber, which is filled with insulating gas, in the case of a compressed gas-blast circuit breaker of the type mentioned initially, while maintaining a high contact separation speed.

The compressed gas-blast circuit breaker according to the invention is distinguished by the fact that it requires only a small amount of drive energy and a small drive force in order to form an insulating path, which can be highly stressed dielectrically, between the two contact members during disconnection. This is primarily a consequence of the suitable arrangement of the speed converter on the force-absorbing contact member. The insulating path can then be formed extremely quickly, with a comparatively small drive force, by suitably driving the functionally essential parts, such as the arcing contact and the main current contact as well as the shields, of the force-absorbing contact member. Furthermore, the chamber, which is filled with insulating gas, has a small diameter transversely to the movement direction of the contact members. The compressed gas-blast circuit breaker according to the invention can thus be designed in a particularly spacesaving and compact manner and is furthermore distinguished by comparatively low product costs.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
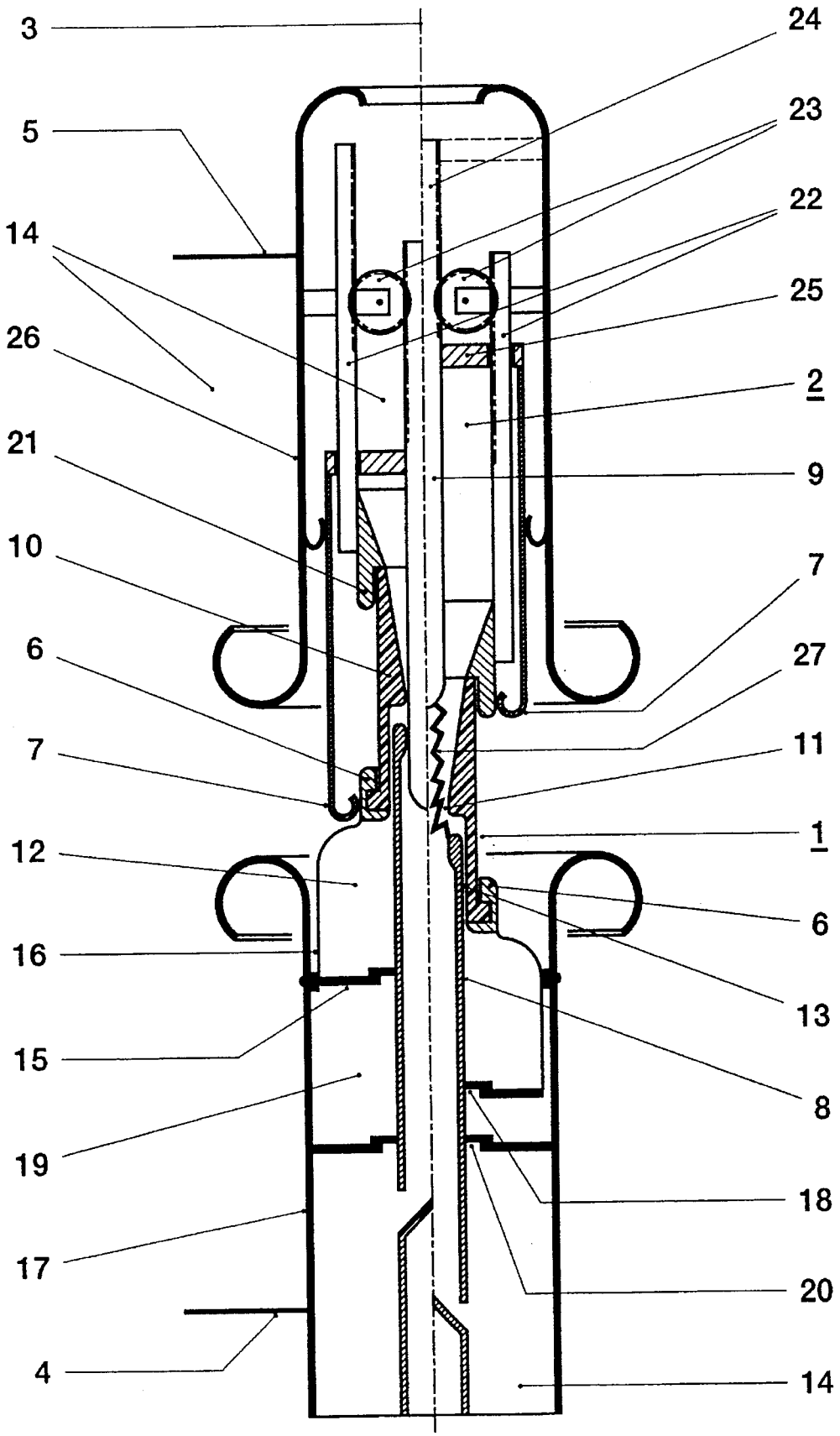
FIG. 1 is an axially sectioned view of a compressed gas-blast circuit breaker in accordance with the invention, the drawing showing on the left of the axis the circuit breaker in a connected position and on the right of the axis the circuit breaker in a disconnected position.

Referring now to the drawings, wherein like reference numerals designate identical or corresponding parts throughout the several views, two contact members 1, 2 of the contact arrangement of a compressed gas-blast circuit breaker are illustrated in FIG. 1. These contact members 1, 2 are arranged in a switching chamber (not illustrated) of a compressed gas-blast circuit breaker, which is filled with insulating gas and has a cylindrical wall made of insulating material. The contact members 1, 2 can be moved into engagement with one another or out of engagement with one another along an axis 3. The two contact members 1, 2 are designed to be essentially rotationally symmetrical and are in each case electrically conductively connected to an electrical terminals 4, 5. Both contact members 1 and 2 respectively each have a main current contact 6 and 7 respectively and an arcing contact 8 and 9 respectively.

The contact member 1 can be displaced along the axis 3 by a drive which is not illustrated and acts approximately on the arcing contact 8. The contact member 1 has an insulating nozzle 10, which is arranged coaxially between the main current contact 6 and the arcing contact 8. In addition, the contact member 1 has a nozzle constriction 11, as well as an annular pressure space 12, which is provided in order to store compressed gas and can be connected to an exhaust space 14 via the nozzle constriction 11 and an annular channel 13 which is arranged between the arcing contact 8 and the inner wall of the insulating nozzle 10. The pressure space 12 is enclosed by a base 15, which runs radially outwards and is mounted on the erosion contact 8, the erosion contact 8 and a hollow cylinder 16 which is fitted on the base 15 and has a part which tapers conically upwards. The hollow cylinder 16 is formed from electrically conductive material. The outer surface of the hollow cylinder 16 makes contact in a sliding manner with a hollow-cylindrical part of the electrical terminal 4, which part acts as a stationary shield 17 for the contact member 1. The base is preferably likewise formed from electrically conductive material to ensure an electrically conductive connection between the shield 17 of the electrical terminal 4 and the arcing contact 8. However, if required, such a connection can be omitted. The main current contact 6 is then advantageously mounted on the arcing contact 8 via conductor parts which are arranged in a star shape and extend through the annular channel 13. One of the ends of the insulating nozzle is mounted on the main current contact 6 in such a manner that the mounting point of the insulating nozzle 10 is coaxially surrounded by the main current contact 6. The main current contact 6 then acts as a shield and reduces the electrical field at the mounting point of the insulating nozzle 10.

A check valve 18 is arranged in the base 15 of the pressure space 12. The check valve 18 makes it possible for gas to flow from a compression space 19 of a piston/cylinder compression device into the pressure space 12, and prevents said gas flowing in the reverse direction. The compression space 19 is formed by the base 15, which is guided in a gas-tight sliding manner in the shield 17, the shield 17, a cylinder base which is mounted in the shield 17 and is fitted with a pressure control device 20, and the arcing contact 8, which is guided in a gas-tight sliding manner by the cylinder base.

The arcing contact 8 is preferably designed as a nozzle and, at its free end, has a nozzle opening which is formed by erosion-resistant contact material. The arcing contact 9, which is designed as a pin, of the contact member 2 penetrates, into the arcing contact 8 in the connected position (left-hand part of FIG. 1) forming a friction-locking contact overlap. At its other end, on which the drive acts, the arcing contact 8 has gas outlet openings which connect its interior to the exhaust space 14.

The insulating nozzle 10 is fitted at its end facing the contact member 2 with a shield 21 which coaxially surrounds the insulating nozzle 10. This shield reduces the electrical field in the dielectrically and mechanically highly stressed upper end of the insulating nozzle 10. The shield 21 is fitted with two racks 22, which are arranged parallel to the axis 3, which are connected to an element used to transmit to the contact member 2 a force produced by the drive. The force is transmitted into the insulating nozzle 10 via the contact member 1. The racks 22 are part of a rack drive having two pinion wheels 23 which are mounted to rotate about stationary shafts and each of which engages on the one hand with one of the two racks 22 and on the other hand with a rack 24 which is provided with a double tooth system. The rack 24 is arranged parallel to the axis 3 and is incorporated in the arcing contact 9 or a part which is connected to it in a force-fitting manner.

The force which is passed from the drive, via the contact member 1, the insulating nozzle 10 and the transmission element, to the arcing contact 9 is passed to the main current contact 7 via an electrical conductor 25 which acts as a further transmission element and rigidly couples the arcing contact 9 to the rated current contact 7 and/or to a shield of this contact. The main current contact 7 and/or its shield is designed in the form of a hollow cylinder and makes sliding contact on the outer surface with a hollow-cylindrical part of the electrical terminal 5 which acts as a stationary shield 26 for the contact member 2. The main current contact 7 and/or its shield surrounds the arcing contact 8, the insulating nozzle 10 and the main current contact 6 coaxially in the connected position. In the disconnected position, the main contact 7 shields the arcing contact 9 and the force output from the insulating nozzle 10 in the region of the shield 21, in addition.

In the connected position (left-hand part of FIG. 1), the two contact members 1, 2 engage with one another and the current which is to be disconnected flows from the shield 17 of the electrical terminal 4, via the hollow cylinder 16 and the main current contacts 6, 7, which make contact with one another, to the shield 26 of the electrical terminal 5. During disconnection, the contact member 1 and the insulating nozzle 10 which is mounted on it are guided downwards by the drive, which is not illustrated. Force is at the same time transmitted to the racks 22 via the insulating nozzle 10. These racks are likewise moved downwards and act on the pinion wheels 23 which, for their part, now guide the rack 24 and thus the arcing contact 9 upwards. Since the arcing contact 9 is rigidly connected via the electrical conductor 25 to the main current contact 7 and/or to the shield which surrounds the main current contact 7, the main current contact 7 and/or the shield surrounding it is now also moved upwards. After a predetermined travel, the two main current contacts 6, 7 are disconnected. The current which is to be disconnected now commutates into a current path which is formed by the base 15, the arcing contacts 8, 9 which are still in contact with one another, and the electrical conductor 25. After a further travel, the two arcing contacts 8, 9 are now also disconnected, forming a switching arc 27 (right-hand half of FIG. 1). Insulating gas which is heated by the energy of the switching arc 27 is stored in the pressure space 12 without any drive energy having to be applied by the switch drive for this purpose. At the same time, insulating gas which is located in the compression space 19 is compressed by the base 15, which is moved downwards together with the arcing contact 8. The compressed gas which is located in the spaces 12 and 19 is used to blow out the switching arc when the current approaches a zero crossing.

As a result of the two arcing contacts 8, 9 and the two main current contacts 6, 7 moving in opposite directions during contact disconnection, a high contact separation speed is achieved. This high contact separation speed ensures that the insulating distances between the arcing contacts 8, 9 and the main current contacts 6, 7 are quickly large enough to be able to withstand the returning voltage. The shield 21, which is moved at the same time, and the rated current contact 6, which acts as a shield, at the same time ensure that the field which is caused by the returning voltage at the points on the insulating nozzle 10 which carry force is reduced.

The electrical field is still further reduced in the disconnected position by the main current contact 7 and/or its shield at the location of the insulating nozzle 10 since the main current contact 7 then surrounds the shield 21. A further improvement in the course of the electrical field between the separated contact members 1, 2 is achieved by the shields 17 and 26 which surround the contact members 1, 2.

Figure 2:
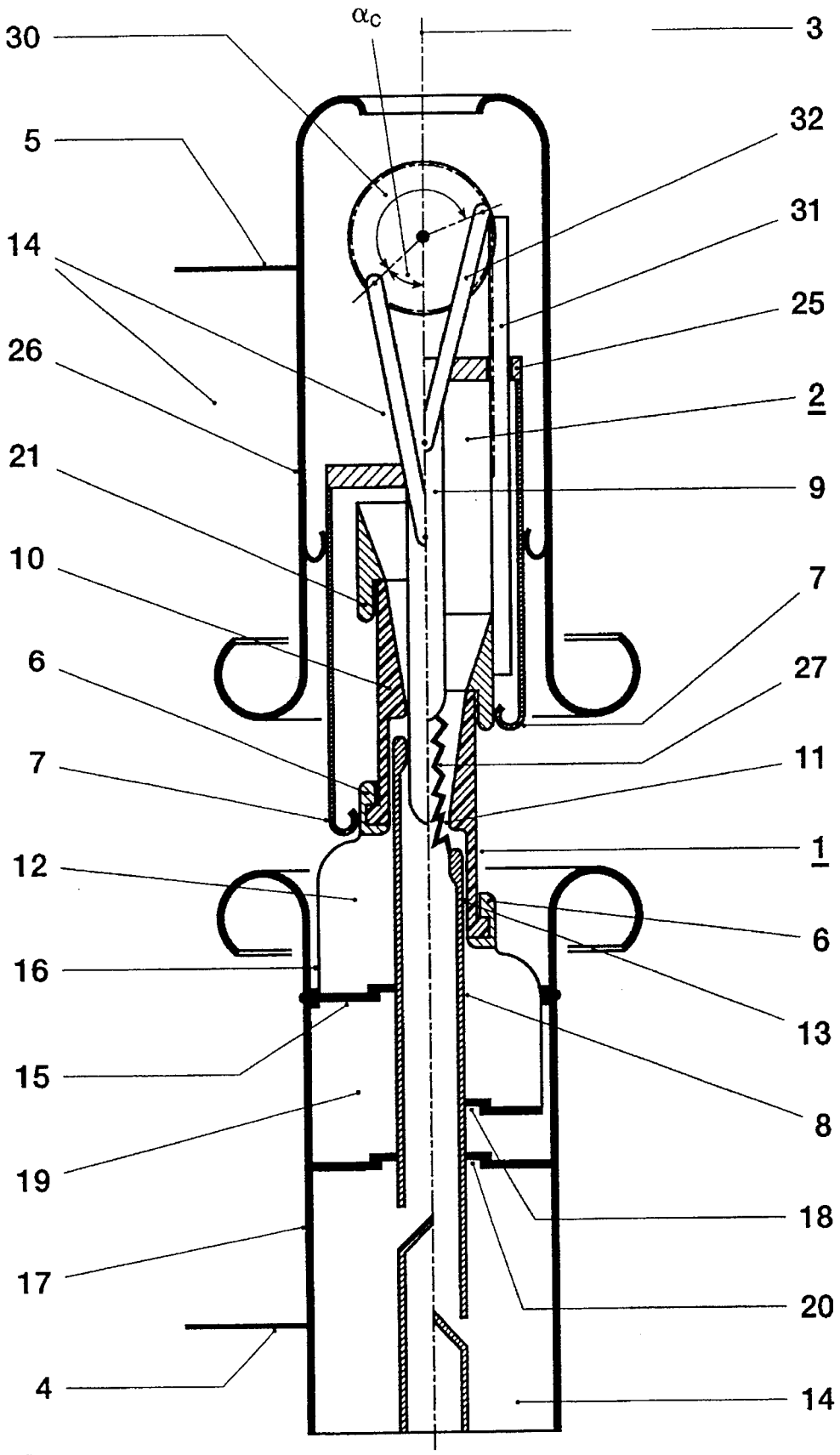
FIG. 2 is an axially sectioned view drawn according to FIG. 1 and showing an alternative linkage for moving contacts of the circuit breaker.

In the case of the embodiment of the compressed gas-blast circuit breaker according to the invention which is illustrated in FIG. 2, a multiple movement of parts of the contact member 2 is achieved in that a transmission element is provided having two series-connected converters. The two converters are designed as drives and are connected together to transmit a non-linear movement to the contact member 2. A first of the two drives has a pinion wheel 30, which is mounted such that it can rotate about a stationary shaft, as well as a rack 31, which is mounted on the shield 17 in a corresponding manner to the racks 22 in the embodiment according to FIG. 1, is arranged parallel to the axis and interacts with the pinion wheel 30. A second of the two drives includes a straight-sliding link having a crank arm 32, one of whose ends is articulated on the pinion wheel 30 and whose other end is articulated at the top on the arcing contact 9.

If the straight-sliding link moves through a rotation angle of less than 180° during a switching operation in the case of this embodiment, then the arcing contact 9 and the main current contact 7 and/or its shield are displaced in a non-linear movement, which is directed in one direction and is in the opposite direction to the first contact member 1. The non-linear movement is expediently carried out such that the contact separation speed is high at the moment when the arcing contacts separate, and such that, subsequently—for example after reaching a separation distance which corresponds to the required insulation distance—the contact separation speed is reduced. This can be achieved advantageously by the crank arm 32 of the straight-sliding link enclosing a relatively small angle with the axis 3 in the connected position, although the deflection $\alpha_c$ of the straight-sliding link should at least be less than 45°. Since the crank arm 32 is then located in the region of a dead-center position of the straight-sliding link, the contact member 2 is initially accelerated slowly. This favors the use of a drive of small dimensions. After the main current contacts 6, 7 have opened, the angle between the crank arm 32 and the axis 3 is increasingly enlarged. The opening of the arcing contacts 8, 9 is then carried out with a high separation speed. When the insulation separation between the arcing contacts 8, 9 is sufficiently large, the straight-sliding link is approaching its upper dead-center position. The contact separation speed is then considerably reduced. As a result of such a movement sequence, the extension of the switching arc 27 is delayed and the energy which is converted in the switching arc is conveyed into the exhaust space 14 is thus also considerably reduced.

Figure 3:
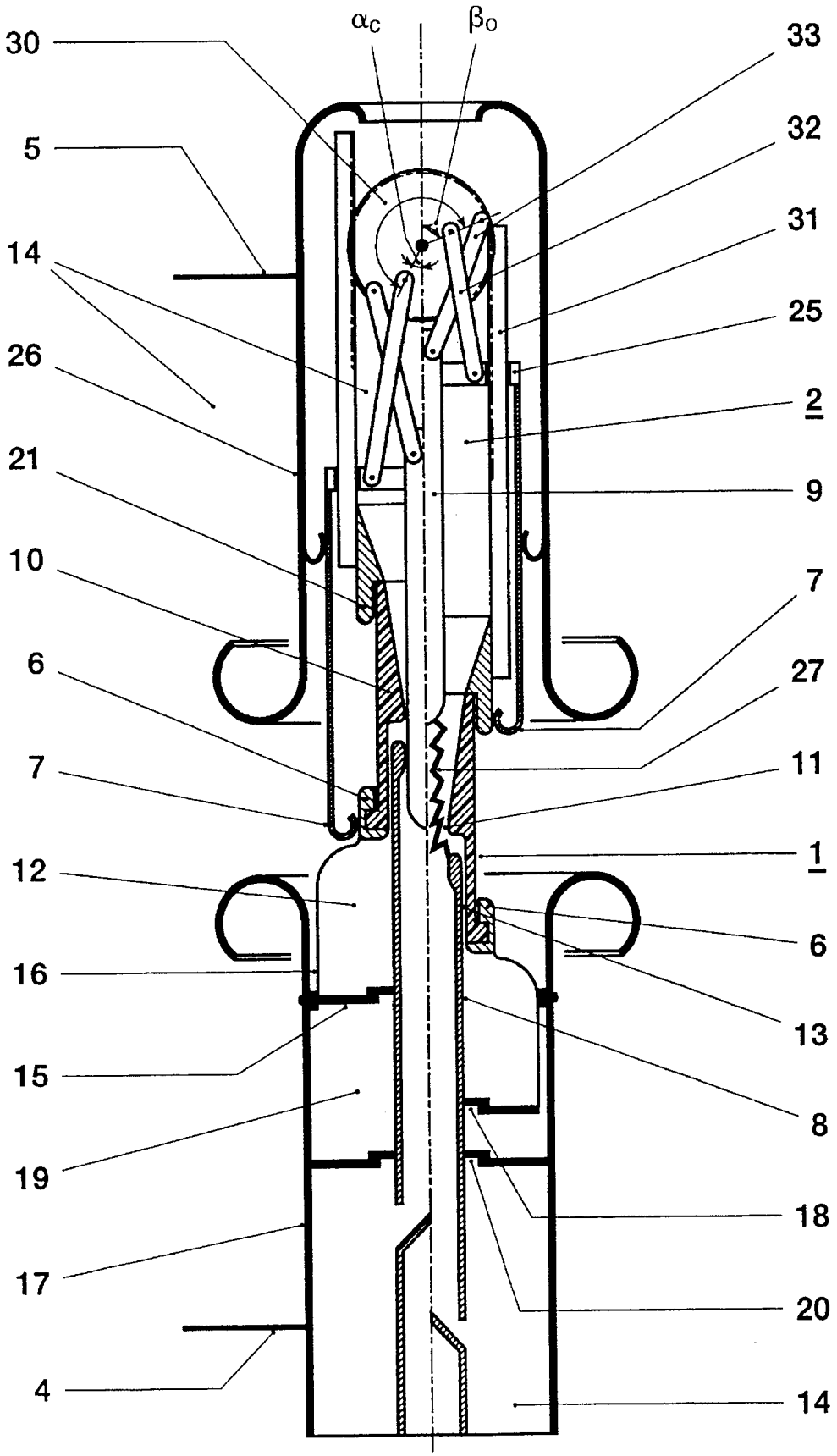
FIG. 3 is an axially sectioned view drawn according to FIG. 1 and shows another alternative linkage for moving the contacts of the circuit breaker.

In the case of the embodiment of the compressed gas-blast circuit breaker according to the invention which is illustrated in FIG. 3, and in comparison with the embodiment according to FIG. 2, different speeds of the arcing contact 9, the rated current contact 7 and the shield of the insulating nozzle 10 are additionally achieved during a disconnection process. In consequence, the force which is applied by the drive can be even better metered and the amount of force required for disconnection can be further reduced. In the case of the connection operation, this embodiment enables reliable pre-striking, irrespective of the arcing condition of the erosion contacts 8, 9, between the arcing contacts and in consequence contributes considerably to extending the life of the circuit breaker. To this end, the straight-sliding link also has a further crank arm 33 in addition to the crank arm 32. One end of the crank arm 33 is articulated on the pinion wheel 30 and its other end is articulated on the electrical conductor 25. The electrical conductor 25 is electrically conductively connected to the arcing contact 9 via a sliding contact, which is not illustrated. The speeds of the arcing contact 9 and the main current contact 7 relative to one another can be defined by suitable articulation of the crank arms 32 and 33. It can be seen from FIG. 3 that the crank arm 32 is articulated on the pinion wheel 30 at the outside and the crank arm 33 is articulated on it close to the axis and that, furthermore, the articulation points are located in the region of the dead-center position of the straight-sliding link in the connected position and enclose a relatively small angle $\alpha_c$ with the axis 3.

During a disconnection procedure, the arcing contact 9 and the main current contact 7 are initially accelerated slowly according to the embodiment in accordance with FIG. 2. This favors the use of a drive of small dimensions which can use its force predominantly to overcome contact forces caused by friction. After the opening of the main current contacts 6, 7, the angle $\alpha_c$ between the articulation points of the crank arms 32 and 33 and the axis 3 is increasingly enlarged. As a result of the greater separation of the articulation point of the crank arm 32 from the axis of the pinion wheel 30, the speed of the arcing contact 9 with respect to the speed of the main current contact 7 is obviously increased. The drive force is now predominantly used to overcome contact forces, caused by friction, between the arcing contacts 8, 9 and in order to accelerate the contact member 2. A large proportion of the force which is applied in order to accelerate the contact member 2 is used to accelerate the arcing contact 9. The opening of the arcing contacts 8, 9 is then carried out at a high separation speed. At the same time, the main current contacts 6, 7 are at a distance from one another at which restrikes are reliably avoided. When the insulation separation between the arcing contacts 8, 9 and the main current contacts 6, 7 is sufficiently large, the straight-sliding link approaches its top dead-center position and the contact separation speed is then considerably reduced, as in the case of the exemplary embodiment according to FIG. 2. Finally, the straight-sliding link is moved into a position in which it forms a comparatively large angle $\beta_o$ with the axis 3, corresponding to the embodiment according to FIG. 2.

As a result of the described movement sequence, the drive force is used completely virtually in every phase of disconnection and an optimal disconnection movement of the contact members is thus produced with a uniform, minimal use of force.

If the pinion wheel 30 is coupled to an articulation disk whose radius is greater that the radius of the pinion wheel 30, then displacement of the articulation point of the crank arm 32 outwards makes it possible to achieve an absolute speed of the arcing contact 9 which is higher than the absolute speed of the shield 21 of the insulation nozzle 10 and of the arcing contact 8. Depending on the design of the pinion wheel 30 and of the articulation disk, the absolute speed of the arcing contact 8 can then be between the absolute speeds of the arcing contact 9 and the main current contact 7 or, alternatively, can be less than either of these two speeds. Compressed gas is then available from the compression space 19 over a long period of time, which makes it possible to blow the switching arc 27 for a longer time.

Figure 4:
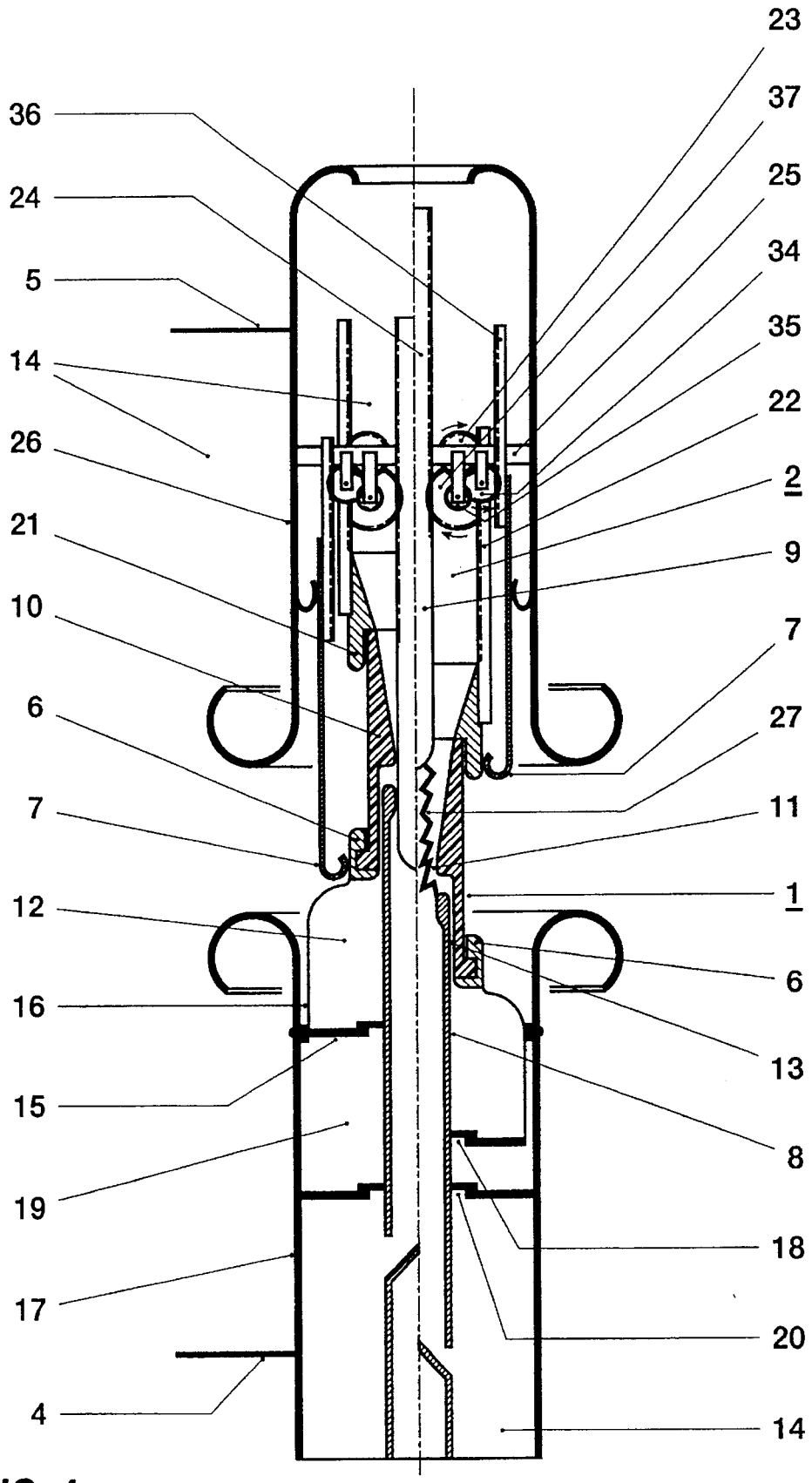
FIG. 4 is an axially sectioned view drawn according to FIG. 1 and shows yet another linkage for moving the contacts of the circuit breaker.

In the case of the embodiment of the compressed gas-blast circuit breaker according to the invention illustrated in FIG. 4, the different speeds, which are described in conjunction with the embodiment according to FIG. 3, of the arcing contact 9, the main current contact 7 and the shield of the insulating nozzle 10 are achieved by means of a rack drive. In addition to the racks 22 and pinion wheels 23, which are provided in pairs in the case of the embodiment in accordance with FIG. 1, the rack drive in FIG. 4 additionally has two pinion wheels 34 and 35 and two further racks 36. The two pinion wheels 23, which are driven by the racks 22, in each case roll on one of the two pinion wheels 34 which, for their part, in each case roll on one of the two racks 36 and one of the two pinion wheels 35. The pinion wheels 35 each have a common axis with the pinion wheels 37, which in each case roll on opposite sides on the rack 24 which is connected to the arcing contact 9.

During disconnection, the racks 22 are moved downwards and the pinion wheels 23 are at the same time rotated corresponding to the exemplary embodiment according to FIG. 1. Each of the pinion wheels 23 now rotates the associated pinion wheel 34 in the opposite direction. On the one hand, the racks 36 and the main current contact 7 which is mounted on it are now displaced upwards (arrow in FIG. 4). On the other hand, the pinion wheels 35 and thus the pinion wheels 37 as well are now also rotated in such a manner that the rack 24 and thus the arcing contact 9 as well are displaced upwards (arrow in FIG. 4). By suitably dimensioning the conversion ratios of the pinion wheels, any desired speeds of the arcing contact 9 and of the main current contact 7 relative to one another and relative to the speed of the drive and/or of the shield 21 can easily be achieved.

Clearly, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A compressed gas-blast circuit breaker comprising:

two contact members which are movable relative to one another along an axis and each contact member having at least one arcing contact and one main current contact, a drive to transmit moving force to a first of the two contact members, an insulating nozzle positioned coaxially to the two contact members and mounted on a first of the two contact members, the insulating nozzle positioned for directing compressed gas during disconnection from one of a compression space, which is operated by the contact members, and a pressure space which is independent of the switching travel, into an exhaust space (14), and a transmission device to transmit drive force from the first contact member through an insulating part to the second contact member, the transmission device having two transmission elements, a first element which acts on the arcing contact and a second element which acts on the main current contact of the second contact member, wherein the insulating part is the insulating nozzle and wherein the insulating nozzle includes at an end facing the second contact member a first shield which coaxially surrounds the insulating nozzle and transmits force produced by the drive from the insulating nozzle to the first transmission element.

2. The circuit breaker as claimed in claim 1, wherein the first shield also transmits force produced by the drive to the second transmission element.

3. The circuit breaker as claimed in claim 1, wherein the insulating nozzle includes at an end used for mounting on the first contact member a second shield which is formed as the main current contact.

4. The circuit breaker as claimed in claim 3, wherein at least one of the first transmission element and the second transmission element transmit movements linearly from the drive to the second contact member.

5. The circuit breaker as claimed in claim 4, wherein the first transmission element is a rack drive having at least one pinion wheel, the wheel mounted to rotate about a stationary axis, and the transmission element having at least two racks arranged parallel to the axis and engaged with the at least one pinion wheel, and a first rack being mounted on the arcing contact of the second contact member and a second rack being mounted on the first shield.

6. The circuit breaker as claimed in claim 5, wherein the second transmission element is an electrical conductor which rigidly connects the arcing contact of the second contact member to at least one of the main current contact and the shield of the main current contact.

7. The circuit breaker as claimed in claim 4, wherein the first transmission element and the second transmission element are part of a rack drive having at least three pinion wheels which are each mounted to rotate about stationary axes, and the rack drive having at least three racks which are arranged parallel to the axis and are engaged with the at least three pinion wheels, wherein a first rack engages a first of the pinion wheels and is mounted on the first shield, a second rack engages a second of the pinion wheels and is mounted on the main current contact of the second contact member, and a third rack engages a third of the pinion wheels and is mounted on the arcing contact of the second contact member.

8. The circuit breaker as claimed in claim 1, wherein at least one of the first transmission element and the second transmission element transmits movements nonlinearly from the drive to the second contact member.

9. The circuit breaker as claimed in claim 8, wherein at least one of the first transmission element and the second transmission element has two series-connected converters.

10. The circuit breaker as claimed in claim 9, wherein the two converters are drives and are connected together to transmit a movement directed in one direction to at least one of the arcing contact and the main current contact of the second contact member.

11. The circuit breaker a claimed in claim 8, wherein the two converters are drives and are connected together to transmit a reverse movement to at least one of the arcing contact and the main current contact of the second contact member.

12. The circuit breaker as claimed in claim 10, wherein a first of the two converter drives has a pinion wheel mounted to rotate about a stationary shaft, and at least one rack arranged parallel to the axis and engaging the pinion wheel, the rack being mounted on the first shield, and wherein a second of the two converter drives includes a straight-sliding link having a crank arm with one end articulated on the pinion wheel and an opposite end articulated on the arcing contact of the second contact member.

13. The circuit breaker as claimed in claim 12, wherein the straight-sliding link is rotatable through an angle of more than 180° during a switching operation.

14. The circuit breaker as claimed in claim 12, wherein the crank arm of the straight-sliding link is positioned in a region of a dead-center position of the crank in the connected position.

15. The circuit breaker as claimed in claim 12, comprising a second crank arm having a first end articulated on the straight-sliding link and a second end interacting with the main current contact of the second contact member.

* * * * *